US011694632B2

(12) United States Patent
Nam et al.

(10) Patent No.: US 11,694,632 B2
(45) Date of Patent: Jul. 4, 2023

(54) POWER VOLTAGE GENERATOR INCLUDING CHARGE PUMP, DISPLAY APPARATUS INCLUDING THE SAME AND METHOD OF GENERATING POWER VOLTAGE USING THE SAME

(71) Applicant: Samsung Display Co., Ltd., Yongin-Si (KR)

(72) Inventors: Yanguk Nam, Hwaseong-si (KR); Hyungrae Nam, Hwaseong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/173,528

(22) Filed: Feb. 11, 2021

(65) Prior Publication Data

US 2021/0335281 A1 Oct. 28, 2021

(30) Foreign Application Priority Data

Apr. 28, 2020 (KR) ..... 10-2020-0051692

(51) Int. Cl.
*G09G 3/3291* (2016.01)

(52) U.S. Cl.
CPC ... *G09G 3/3291* (2013.01); *G09G 2310/0291* (2013.01); *G09G 2330/028* (2013.01)

(58) Field of Classification Search
CPC ..... G09G 3/2092; G09G 3/2096; G09G 3/30–3291; G09G 3/3696; G09G 2310/0243; G09G 2310/0289; G09G 2310/0291; G09G 2330/023; G09G 2330/028; G11C 5/145; H02M 1/006; H02M 1/0016; H02M 1/0019; H02M 1/0025; H02M 3/07–078
See application file for complete search history.

(56) References Cited

U.S. PATENT DOCUMENTS

| | | | | |
|---|---|---|---|---|
| 8,989,306 | B1 * | 3/2015 | Yeung | G05F 1/10 375/297 |
| 10,483,846 | B1 * | 11/2019 | Allegrini | H02M 3/07 |
| 2002/0036636 | A1 * | 3/2002 | Yanagi | H02M 3/073 345/211 |
| 2002/0070794 | A1 * | 6/2002 | Gariboldi | H02M 3/073 327/540 |
| 2002/0110009 | A1 * | 8/2002 | Umeda | H02M 3/07 363/60 |
| 2005/0258772 | A1 * | 11/2005 | Park | G09G 3/3225 315/169.1 |
| 2006/0181340 | A1 * | 8/2006 | Dhuyvetter | H03F 3/70 330/6 |

(Continued)

FOREIGN PATENT DOCUMENTS

| | | | |
|---|---|---|---|
| KR | 1020160059035 | A | 5/2016 |
| KR | 1020170066771 | A | 6/2017 |
| KR | 1020180090706 | A | 8/2018 |

*Primary Examiner* — Keith L Crawley
(74) *Attorney, Agent, or Firm* — Cantor Colburn LLP

(57) ABSTRACT

A power voltage generator includes a charge pump and a regulator. The charge pump generates a charge pumping voltage. The charge pumping voltage has a headroom margin which is automatically set. The charge pumping voltage is varied based on a target voltage. The regulator generates a power voltage based on the charge pumping voltage.

16 Claims, 8 Drawing Sheets

(56) References Cited

U.S. PATENT DOCUMENTS

| | | | | |
|---|---|---|---|---|
| 2006/0193156 | A1* | 8/2006 | Kaishita | H02M 3/07 363/123 |
| 2008/0018321 | A1* | 1/2008 | Clavette | H02M 3/157 323/316 |
| 2009/0079495 | A1* | 3/2009 | Morita | G09G 3/3696 327/538 |
| 2009/0109142 | A1 | 4/2009 | Takahara | |
| 2010/0033409 | A1* | 2/2010 | Park | G09G 3/3233 345/76 |
| 2012/0044231 | A1* | 2/2012 | Park | G09G 3/3233 345/211 |
| 2012/0218032 | A1* | 8/2012 | Nadimpalli | H02M 3/073 327/536 |
| 2015/0077175 | A1* | 3/2015 | Giuliano | H02M 3/07 327/536 |
| 2018/0120884 | A1* | 5/2018 | King | H03F 1/025 |
| 2018/0136680 | A1* | 5/2018 | Du | G05F 1/575 |

* cited by examiner

| REGISTER | VALUE |
|---|---|
| HM-VCP1 | 0.3V |
| HM-VCP2 | 0.3V |
| ILOAD1 | 0V |
| ILOAD2 | 0.05V |
| ⋮ | ⋮ |
| ILOADN-1 | 0.7V |
| ILOADN | 0.75V |
| HM-VCP1-EN | 0:OFF,1:ON |
| HM-VCP2-EN | 0:OFF,1:ON |

| | VGL PL | VINT PL | TOTAL PL |
|---|---|---|---|
| COMPARATIVE EMBODIMENT | 10.5mW (HM=2.3V) | 20.5mW (HM=4.3V) | 31mW |
| EXAMPLE EMBODIMENT | 1.5mW (HM=0.3V) | 1.5mW (HM=0.3V) | 3mW |
| DIFFERENCE | 9mW | 19mW | 28mW |

POWER VOLTAGE GENERATOR INCLUDING CHARGE PUMP, DISPLAY APPARATUS INCLUDING THE SAME AND METHOD OF GENERATING POWER VOLTAGE USING THE SAME

This application claims priority to Korean Patent Application No. 10-2020-0051692, filed on Apr. 28, 2020, and all the benefits accruing therefrom under 35 U.S.C. § 119, the content of which in its entirety is herein incorporated by reference.

BACKGROUND

1. Field

Embodiments of the invention relate to a power voltage generator, a display apparatus including the power voltage generator and a method of generating a power voltage using the power voltage generator. More particularly, embodiments of the invention relate to a power voltage generator that generates a charge pumping voltage having an automatically set headroom margin and varied based on a target voltage, a display apparatus including the power voltage generator and a method of generating a power voltage using the power voltage generator.

2. Description of the Related Art

Generally, a display apparatus includes a display panel and a display panel driver. The display panel may include a plurality of gate lines, a plurality of data lines, a plurality of emission lines and a plurality of pixels. The display panel driver may include a gate driver, a data driver, an emission driver, a power voltage generator and a driving controller. The gate driver may output gate signals to the gate lines. The data driver may output data voltages to the data lines. The emission driver may output emission signals to the emission lines. The power voltage generator may generate a power voltage. The driving controller may control the gate driver, the data driver and the emission driver.

SUMMARY

In a display apparatus, a power voltage generator may include a charge pump circuit that generates a charge pumping voltage for generating a power voltage. The charge pump circuit may generate several fixed charge pumping voltages so that the headroom margin may not be optimized and the power consumption may be large.

Embodiments of the invention provide a power voltage generator that generates a charge pumping voltage having an automatically set headroom margin and varied based on a target voltage to reduce a power consumption of a display apparatus.

Embodiments of the invention also provide a display apparatus including the power voltage generator.

Embodiments of the invention also provide a method of generating a power voltage using the power voltage generator.

In an embodiment of a power voltage generator according to the invention, the power voltage generator includes a charge pump and a regulator. In such an embodiment, the charge pump generates a charge pumping voltage, where the charge pumping voltage has a headroom margin which is automatically set, and the charge pumping voltage is varied according to a target voltage. In such an embodiment, the regulator generates a power voltage based on the charge pumping voltage.

In an embodiment, as an absolute value of the target voltage increases, an absolute value of the charge pumping voltage may increase.

In an embodiment, the headroom margin may be varied according to an output load.

In an embodiment, as the output load increases, an absolute value of the headroom margin may increase. In such an embodiment, as the output load increases, the absolute value of the charge pumping voltage may increase.

In an embodiment, the charge pump may include an operator which generates a reference charge pumping voltage varied based on the target voltage, a comparator which compares a feedback voltage of the charge pumping voltage and the reference charge pumping voltage, a flip-flop which outputs a control signal based on a clock signal and an output signal of the comparator and a switching controller which generates a switching control signal based on an output signal of the flip-flop.

In an embodiment, the charge pump may further include a first amplifier, a second amplifier, a third amplifier and a fourth amplifier which receive the switching control signal, a first switch connected to the first amplifier, a second switch connected to the second amplifier, a third switch connected to the third amplifier and a fourth switch connected to the third amplifier. In such an embodiment, the first switch, the fourth switch, the second switch and the third switch may be sequentially connected to each other in series.

In an embodiment, the charge pump may further include a first capacitor including a first electrode connected to the first switch and the fourth switch, and a second electrode connected to the second switch and the third switch, and a second capacitor including a first electrode connected to the third switch, and a second electrode connected to a ground.

In an embodiment, when the switching control signal has a first level, the first switch and the second switch may be turned on and the third switch and the fourth switch may be turned off. In such an embodiment, when the switching control signal has a second level, the third switch and the fourth switch may be turned on and the first switch and the second switch may be turned off.

In an embodiment, when the switching control signal has the first level, the first capacitor may be charged. In such an embodiment, when the switching control signal has the second level, a voltage charged at the first capacitor may be outputted to the regulator through the third switch.

In an embodiment, the power voltage generator may further include a level shifter connected between the switching controller and the first to fourth amplifiers.

In an embodiment, when an absolute value of the feedback voltage is less than the reference charge pumping voltage, the output signal of the comparator may have a first level. In such an embodiment, when the absolute value of the feedback voltage is equal to or greater than the reference charge pumping voltage, the output signal of the comparator may have a second level.

In an embodiment, the regulator may include a fifth amplifier and a fifth switch connected to an output node of the fifth amplifier. In such an embodiment, a control node of the fifth switch may be connected to the output node of the fifth amplifier, and the charge pumping voltage may be applied to an input node of the fifth switch. In such an embodiment, an output node of the fifth switch may output the power voltage.

In an embodiment, the regulator may further include a first resistor including a first end portion connected to the output node of the fifth switch and a second end portion connected to a first input node of the fifth amplifier, a second resistor including a first end portion connected to the second end portion of the first resistor and a second end portion connected to a ground, and a stabilization capacitor including a first electrode connected to the output node of the fifth switch and a second electrode connected to the ground.

In an embodiment of a display apparatus according to the invention, the display apparatus includes a display region, a gate driver, a data driver and a power voltage generator. In such an embodiment, the display region displays an image, the gate driver provides a gate signal to the display region, the data driver provides a data voltage to the display region, and the power voltage generator outputs a power voltage to at least one of the display region, the gate driver and the data driver. In such an embodiment, the power voltage generator includes a charge pump which generates a charge pumping voltage and a regulator which generates the power voltage based on the charge pumping voltage. In such an embodiment, the charge pumping voltage has a headroom margin which is automatically set, and the charge pumping voltage is varied based on a target voltage.

In an embodiment, the power voltage may be an initialization voltage outputted to a pixel of the display region.

In an embodiment, the power voltage may be a gate low voltage outputted to the gate driver. In such an embodiment, the gate low voltage may define a low level of the gate signal.

In an embodiment, the power voltage generator may further include a second charge pump which generates a second charge pumping voltage and a second regulator which generates a second power voltage based on the second charge pumping voltage. In such an embodiment, the second charge pumping voltage may have an automatically set second headroom margin, and the second charge pumping voltage may be varied according to a second target voltage.

In an embodiment, the power voltage may be an initialization voltage outputted to a pixel of the display region. In such an embodiment, the second power voltage may be a gate low voltage outputted to the gate driver, and the gate low voltage may define a low level of the gate signal.

In an embodiment, the headroom margin may be varied based on an output load.

In an embodiment of a method of generating a power voltage, the method includes generating a charge pumping voltage, and generating the power voltage based on the charge pumping voltage. In such an embodiment, the charge pumping voltage has a set headroom margin which is automatically set, and the charge pumping voltage is varied based on a target voltage. In such an embodiment, the headroom margin is varied based on an output load.

According to embodiments of the power voltage generator, the display apparatus and the method of generating the power voltage, the charge pump may generate the charge pumping voltage having an automatically set headroom margin and varied based on the target voltage so that the headroom margin of the charge pumping voltage may be optimized. Thus, the power consumption of the display apparatus may be reduced.

In such embodiments, the charge pump circuit may adjust the headroom margin of the charge pumping voltage based on the intensity of the output load so that the headroom margin of the charge pumping voltage may be further optimized. Thus, the power consumption of the display apparatus may be further reduced.

BRIEF DESCRIPTION OF THE DRAWINGS

The above and other features of the invention will become more apparent by describing in detailed embodiments thereof with reference to the accompanying drawings, in which.

DETAILED DESCRIPTION

Figure 1:
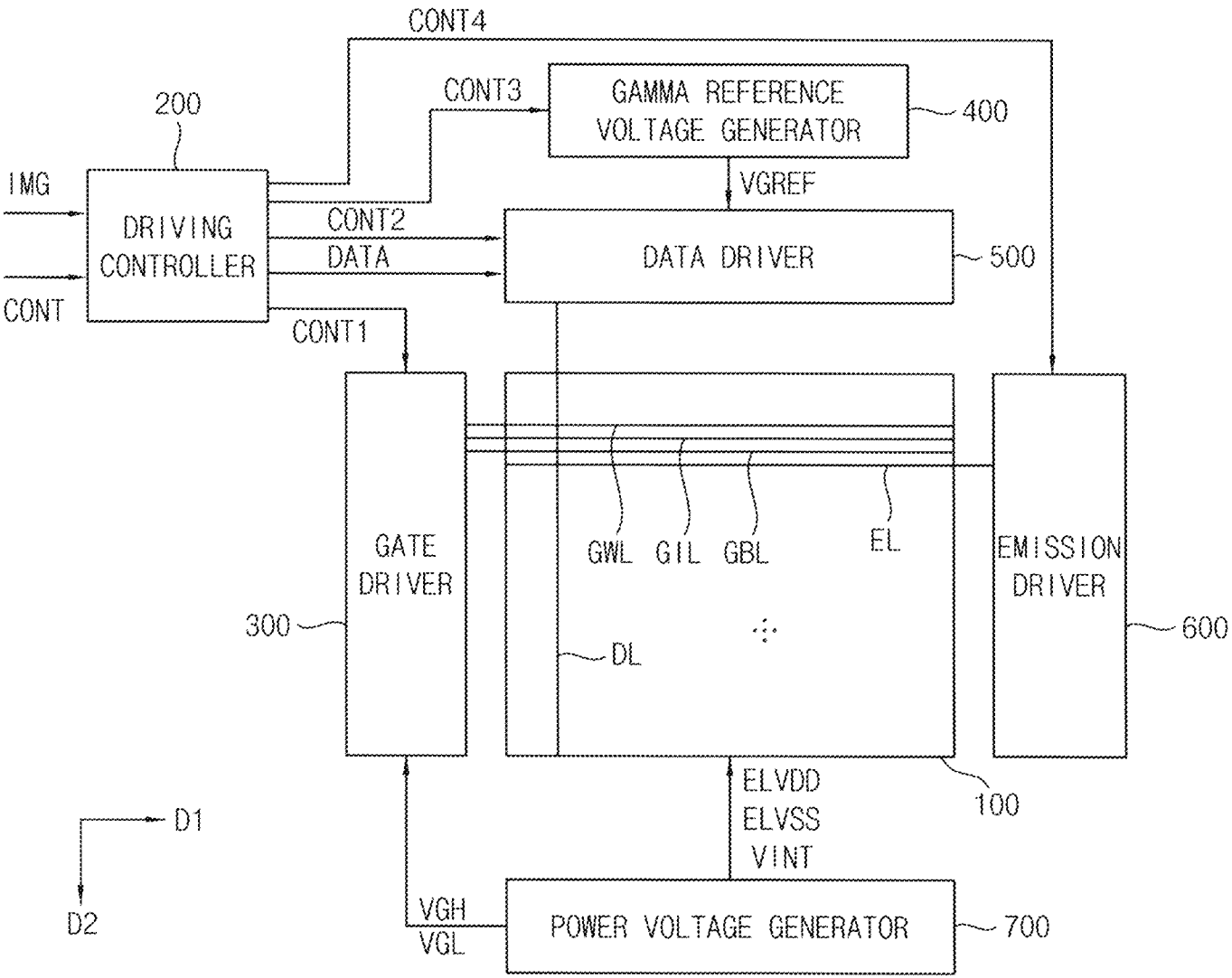
FIG. 1 is a block diagram illustrating a display apparatus according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in detail with reference to the accompanying drawings.

FIG. 1 is a block diagram illustrating a display apparatus according to an embodiment of the invention.

Referring to FIG. 1, an embodiment of the display apparatus includes a display panel 100 and a display panel driver. The display panel driver includes a driving controller 200, a gate driver 300, a gamma reference voltage generator 400, a data driver 500 and an emission driver 600. The display panel driver further includes a power voltage generator 700.

The display panel 100 includes a display region, on which an image is displayed, and a peripheral region adjacent to the display region.

The display panel 100 includes a plurality of gate lines GWL, GIL and GBL, a plurality of data lines DL, a plurality of emission lines EL and a plurality of pixels electrically connected to the gate lines GWL, GIL and GBL, the data lines DL and the emission lines EL. In an embodiment, the gate lines GWL, GIL and GBL extend in a first direction D1, the data lines DL extend in a second direction D2 crossing the first direction D1, and the emission lines EL extend in the first direction D1.

The driving controller 200 receives input image data IMG and an input control signal CONT from an external apparatus. In one embodiment, for example, the input image data IMG may include red image data, green image data and blue image data. The input image data IMG may further include white image data. In an alternative embodiment, the input image data IMG may include magenta image data, cyan image data and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals for driving the gate lines GWL, GIL and GBL in response to the first control signal CONT1 received from the driving controller 200. The gate driver 300 may sequentially output the gate signals to the gate lines GWL, GIL and GBL. In one embodiment, for example, the gate driver 300 may be integrated on the peripheral region of the display panel 100. In one embodiment, for example, the gate driver 300 may be mounted on the peripheral region of the display panel 100, e.g., in a form of an integrated circuit ("IC") chip.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed or included in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages of an analog type using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL. In one embodiment, for example, the emission driver 600 may be integrated on the peripheral region of the display panel 100. In one embodiment, for example, the emission driver 600 may be mounted on the peripheral region of the display panel 100. In an embodiment, the gate driver 300 may be disposed at a first side of the display panel 100 and the emission driver 600 is disposed at a second side of the display panel opposite to the first side of the display panel 100 as shown in FIG. 1, but the invention may not be limited thereto. Alternatively, the gate driver 300 and the emission driver 600 may be disposed at a same side as each other with respect to the display panel 100. In one embodiment, for example, the gate driver 300 and the emission driver 600 may be integrated on the peripheral region at a same side of the display panel 100.

The power voltage generator 700 may provide a power voltage at least one selected from the display panel 100, the driving controller 200, the gate driver 300, the gamma reference voltage generator 400, the data driver 500 and the emission driver 600.

In one embodiment, for example, the power voltage generator 700 may output an initialization voltage VINT to the display panel 100. In one embodiment, for example, the power voltage generator 700 may output a high power voltage ELVDD and a low power voltage ELVSS to a pixel of the display panel 100. In an embodiment, the display apparatus may be an organic light emitting display apparatus including an organic light emitting element. However, the invention may not be limited to the organic light emitting display apparatus.

In one embodiment, for example, the power voltage generator 700 may generate a first gate power voltage VGH and a second gate power voltage VGL to be used to generate the gate signal, and output the first gate power voltage VGH and the second gate power voltage VGL to the gate driver 300.

In one embodiment, for example, the power voltage generator 700 may generate an analog high voltage for determining a level of the data voltage and output the analog high voltage to the data driver 500.

Figure 2:
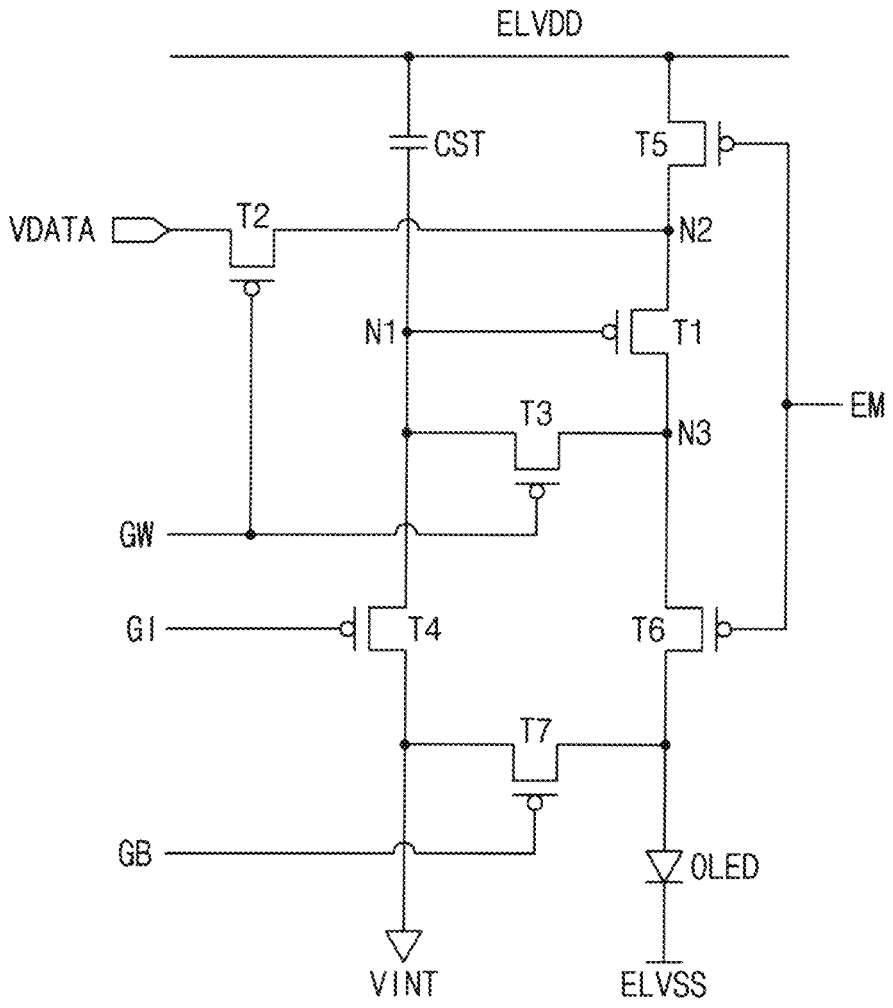
FIG. 2 is a circuit diagram illustrating an embodiment of a pixel of a display panel of FIG. 1.
Figure 3:
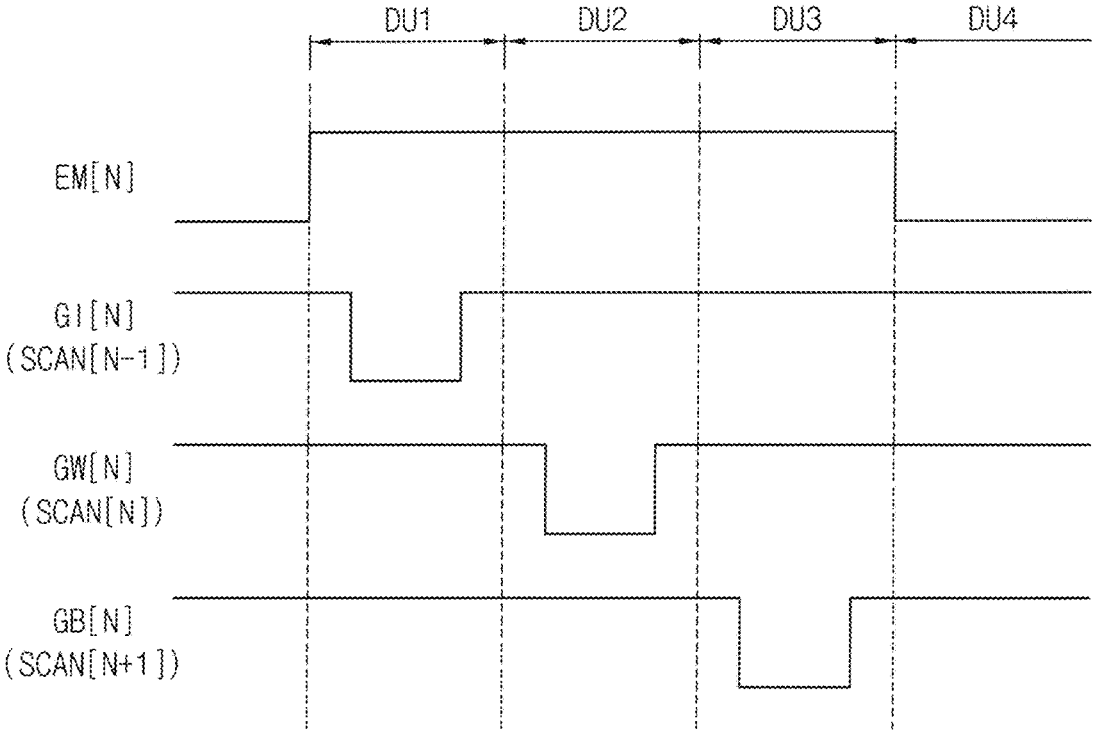
FIG. 3 is a timing diagram illustrating an embodiment of input signals applied to the pixel of FIG. 2.

FIG. 2 is a circuit diagram illustrating an embodiment of a pixel of the display panel 100 of FIG. 1. FIG. 3 is a timing diagram illustrating an embodiment of input signals applied to the pixel of FIG. 2.

Referring to FIGS. 1 to 3, an embodiment of the display panel 100 includes the plurality of the pixels. In such an embodiment, each pixel includes an organic light emitting element OLED.

The pixels receive a data write gate signal GW, a data initialization gate signal GI, an organic light emitting element initialization gate signal GB, the data voltage VDATA and the emission signal EM, and the organic light emitting elements OLED of the pixels emit light corresponding to the level of the data voltage VDATA to display the image.

In an embodiment, as shown in FIG. 2, a pixel of the pixels may include first to seventh thin film transistors T1 to T7, a storage capacitor CST and the organic light emitting element OLED.

The first thin film transistor T1 includes a control electrode connected to a first pixel node N1, an input electrode connected to a second pixel node N2 and an output electrode connected to a third pixel node N3.

In one embodiment, for example, the first thin film transistor T1 may be a P-type thin film transistor. The control electrode of the first thin film transistor T1 may be a gate electrode, the input electrode of the first thin film transistor T1 may be a source electrode and the output electrode of the first thin film transistor T1 may be a drain electrode.

The second thin film transistor T2 includes a control electrode to which the data write gate signal GW is applied, an input electrode to which the data voltage VDATA is applied and an output electrode connected to the second pixel node N2.

The third thin film transistor T3 includes a control electrode to which the data write gate signal GW is applied, an input electrode connected to the first pixel node N1 and an output electrode connected to the third pixel node N3.

The fourth thin film transistor T4 includes a control electrode to which the data initialization gate signal GI is applied, an input electrode to which the initialization voltage VINT is applied and an output electrode connected to the first pixel node N1.

The fifth thin film transistor T5 includes a control electrode to which the emission signal EM is applied, an input electrode to which a high power voltage ELVDD is applied and an output electrode connected to the second pixel node N2.

The sixth thin film transistor T6 includes a control electrode to which the emission signal EM is applied, an input electrode connected to the third pixel node N3 and an output electrode connected to an anode electrode of the organic light emitting element OLED.

The seventh thin film transistor T7 includes a control electrode to which the organic light emitting element initialization gate signal GB is applied, an input electrode to which the initialization voltage VINT is applied and an output electrode connected to the anode electrode of the organic light emitting element OLED.

In one embodiment, for example, the first to seventh thin film transistors T1 to T7 may be P-type thin film transistors. The control electrodes of the first to seventh thin film transistors T1 to T7 may be gate electrodes, the input electrodes of the first to seventh thin film transistors T1 to T7 may be source electrodes and the output electrodes of the first to seventh thin film transistors T1 to T7 may be drain electrodes.

Alternatively, the first to seventh thin film transistors T1 to T7 may be N-type thin film transistors.

The storage capacitor CST includes a first electrode to which the high power voltage ELVDD is applied and a second electrode connected to the first pixel node N1.

The organic light emitting element OLED includes the anode electrode and a cathode electrode to which a low power voltage ELVSS is applied.

In an embodiment, as shown in FIG. 3, during a first duration DU1 the first pixel node N1 and the storage capacitor CST are initialized in response to the data initialization gate signal GI. During a second duration DU2, a compensation for a threshold voltage (VTH) of the first thin film transistor T1 is performed and the data voltage VDATA compensated based on the threshold voltage (VTH) is written to the first pixel node N1 in response to the data write gate signal GW. During a third duration DU3, the anode electrode of the organic light emitting element OLED is initialized in response to the organic light emitting element initialization gate signal GB. During a fourth duration DU4, the organic light emitting element OLED emit the light in response to the emission signal EM so that the display panel 100 displays the image.

During the first duration DU1, the data initialization gate signal GI may have an active level. In one embodiment, for example, the active level of the data initialization gate signal GI may be a low level. When the data initialization gate signal GI has the active level, the fourth thin film transistor T4 is turned on so that the initialization voltage VINT may be applied to the first pixel node N1. The data initialization gate signal GI[N] of a current stage may be a scan signal SCAN[N−1] of a previous stage.

During the second duration DU2, the data write gate signal GW may have an active level. In one embodiment, for example, the active level of the data write gate signal GW may be a low level. When the data write gate signal GW has the active level, the second thin film transistor T2 and the third thin film transistor T3 are turned on. In addition, the first thin film transistor T1 is turned on in response to the initialization voltage VINT applied to the first pixel node N1. The data write gate signal GW[N] of the current stage may be a scan signal SCAN[N] of the current stage.

A voltage generated by subtracting an absolute value (|VTH|) of the threshold voltage of the first thin film transistor T1 from the data voltage VDATA may be charged at the first pixel node N1 along a path generated by the first to third thin film transistors T1, T2 and T3.

During the third duration DU3, the organic light emitting element initialization gate signal GB may have an active level. In one embodiment, for example, the active level of the organic light emitting element initialization gate signal GB may be a low level. When the organic light emitting element initialization gate signal GB has the active level, the seventh thin film transistor T7 is turned on so that the initialization voltage VINT may be applied to the anode electrode of the organic light emitting element OLED. The organic light emitting element initialization gate signal GB[N] of the current stage may be a scan signal SCAN[N+1] of a next stage.

In an embodiment, the active duration of the organic light emitting element initialization gate signal GB may be different from the active duration of the data write gate signal GW, but not being limited thereto. Alternatively, the active duration of the organic light emitting element initialization gate signal GB may be substantially same as the active duration of the data write gate signal GW. In one embodiment, for example, the organic light emitting element initialization gate signal GB[N] of the current stage may be the scan signal SCAN[N] of the current stage. In one embodiment, for example, the control electrode of the seventh thin film transistor T7 may be connected to the control electrode of the second thin film transistor T2.

During the fourth duration DU4, the emission signal EM (or the emission signal of the current stage EM[N]) may have an active level. The active level of the emission signal EM may be a low level. When the emission signal EM has the active level, the fifth thin film transistor T5 and the sixth thin film transistor T6 are turned on. In addition, the first thin film transistor T1 is turned on by the data voltage VDATA.

A driving current flows through the fifth thin film transistor T5, the first thin film transistor T1 and the sixth thin film transistor T6 to drive the organic light emitting element OLED. An intensity of the driving current may be determined by the level of the data voltage VDATA. A luminance of the organic light emitting element OLED is determined by the intensity of the driving current.

Figure 4:
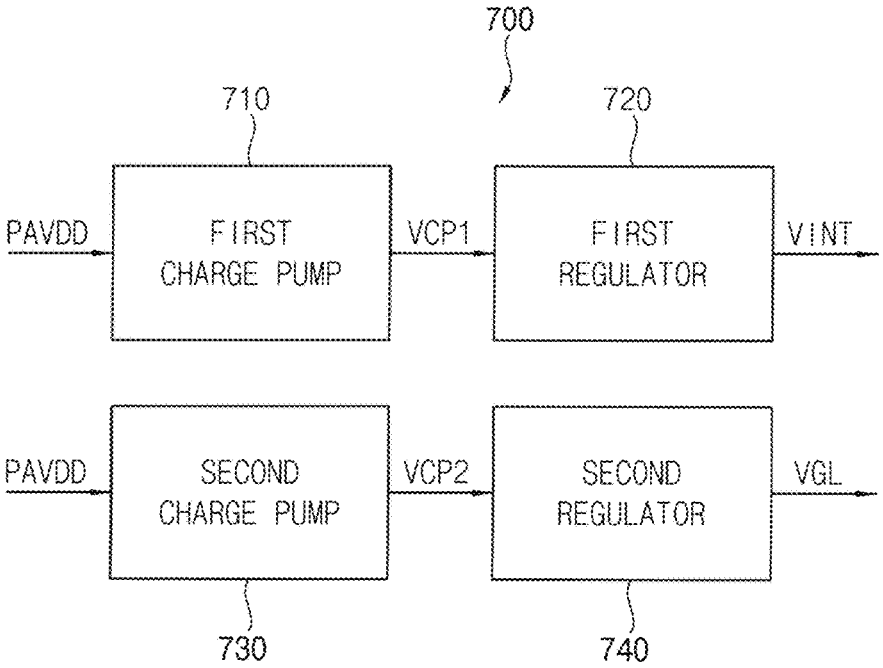
FIG. 4 is a block diagram illustrating an embodiment of a power voltage generator of FIG. 1.

FIG. 4 is a block diagram illustrating an embodiment of the power voltage generator 700 of FIG. 1.

Referring to FIGS. 1 to 4, an embodiment of the power voltage generator 700 may include a first charge pump 710 and a first regulator 720. The first charge pump 710 may generate a first charge pumping voltage VCP1. The first charge pumping voltage VCP1 may have a first headroom margin which is automatically set. The first charge pumping voltage VCP1 may be varied according to a first target voltage. The first regulator 720 may generate a first power voltage (e.g. VINT) based on the first charge pumping voltage VCP1.

The first charge pump 710 may generate the first charge pumping voltage VCP1 based on a charge pumping power voltage PAVDD.

In one embodiment, for example, the first power voltage VINT may be the initialization voltage VINT output to the pixel of the display panel 100. The initialization voltage VINT may be applied to the input electrode of the fourth thin film transistor T4 of FIG. 2.

In such an embodiment, as an absolute value of the first target voltage (the target value of VINT) increases, an absolute value of the first charge pumping voltage VCP1 may increase. In one embodiment, for example, when the first headroom margin is 0.3 volt (V) and the first target voltage is −3.5 V, the first charge pumping voltage VCP1 may be set to −3.8 V which is obtained by subtracting 0.3 V from −3.5 V. In one embodiment, for example, when the first headroom margin is 0.3 V and the first target voltage is −3.7 V, the first charge pumping voltage VCP1 may be set to −4.0 V which is obtained by subtracting 0.3 V from −3.7 V.

In such an embodiment, the first headroom margin may be varied according to the output load of the first power voltage VINT. As the output load of the first power voltage VINT increases, an absolute value of the first headroom margin may increase. In one embodiment, for example, when the first headroom margin for a first output load is 0.3 V and the first target voltage is −3.5 V, the first charge pumping voltage VCP1 may be set to −3.8 V which is obtained by subtracting 0.3 V from −3.5 V. In one embodiment, for example, when the output load is a second output load which is greater than the first output load, the first headroom margin may be set to 0.4 V instead of 0.3 V. Thus, when the first headroom margin for the second output load is 0.4 V and the first target voltage is −3.5 V, the first charge pumping voltage VCP1 may be set to −3.9 V which is obtained by subtracting 0.4 V from −3.5 V. In an embodiment, as described above, when the output load increases, the absolute value of the first charge pumping voltage VCP1 may increase.

The power voltage generator 700 may further include a second charge pump 730 and a second regulator 740. The second charge pump 730 may generate a second charge pumping voltage VCP2. The second charge pumping voltage VCP2 may have a second headroom margin which is automatically set. The second charge pumping voltage VCP2 may be varied according to a second target voltage. The second regulator 740 may generate a second power voltage (e.g. VGL) based on the second charge pumping voltage VCP2.

The second charge pump 730 may generate the second charge pumping voltage VCP2 based on a charge pumping power voltage PAVDD.

Similarly to the first charge pumping voltage VCP1, as an absolute value of the second target voltage (the target value of VGL) increases, an absolute value of the second charge pumping voltage VCP2 may increase. In one embodiment, for example, when the second headroom margin is 0.3 V and the second target voltage is −8.8 V, the second charge pumping voltage VCP2 may be set to −9.1 V which is obtained by subtracting 0.3 V from −8.8 V. In one embodiment, for example, when the second headroom margin is 0.3 V and the second target voltage is −9.0 V, the second charge pumping voltage VCP2 may be set to −9.3 V which is obtained by subtracting 0.3 V from −9.0V.

In such an embodiment, the second headroom margin may be varied according to the output load of the second power voltage VGL. As the output load of the second power voltage VGL increases, an absolute value of the second headroom margin may increase.

The structure and the operation of the first charge pump 710 will be described in greater detail referring to FIGS. 5 to 8. The second charge pump 730 may have a same structure as the first charge pump 710 and may operate in a same manner as the first charge pump 710.

The structure and the operation of the first regulator 720 will be described in greater detail referring to FIG. 9. The second regulator 740 may have a same structure as the first regulator 720 and may operate in a same manner as the first regulator 720.

Figure 5:
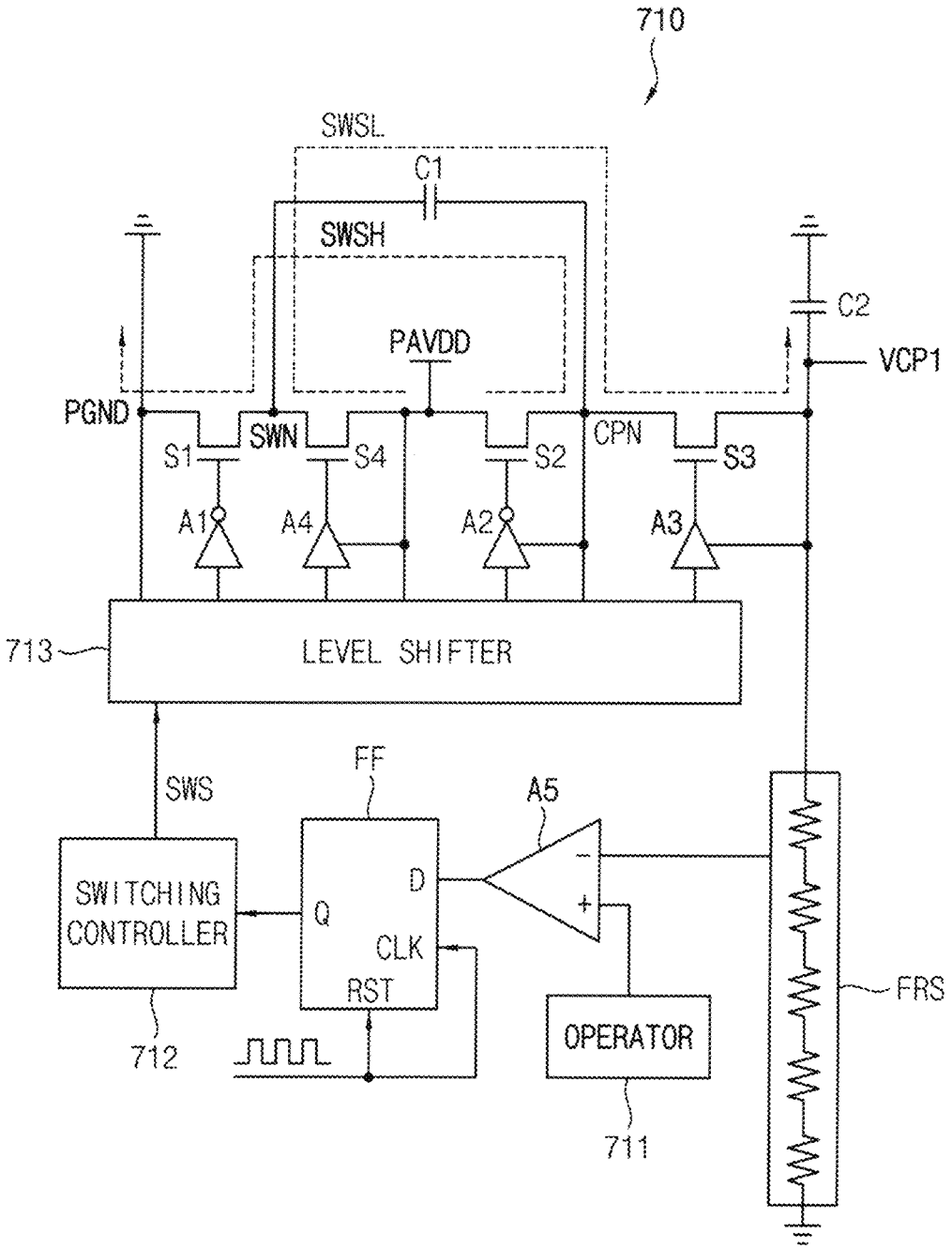
FIG. 5 is a circuit diagram illustrating an embodiment of a first charge pump of FIG. 4.
Figure 6:
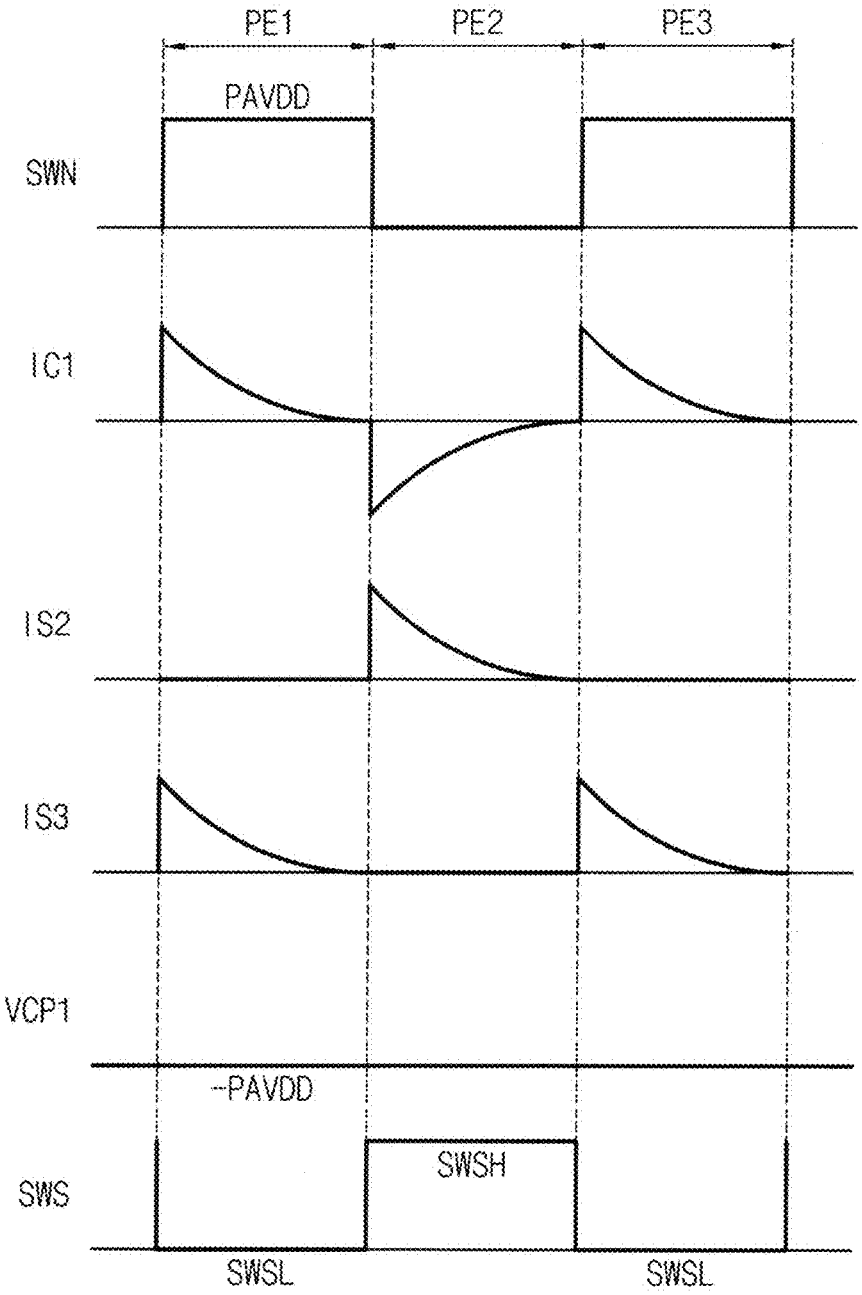
FIG. 6 is a timing diagram illustrating an embodiment of an input signal, a node signal and an output signal of the first charge pump of FIG. 5.
Figures 7, 8:
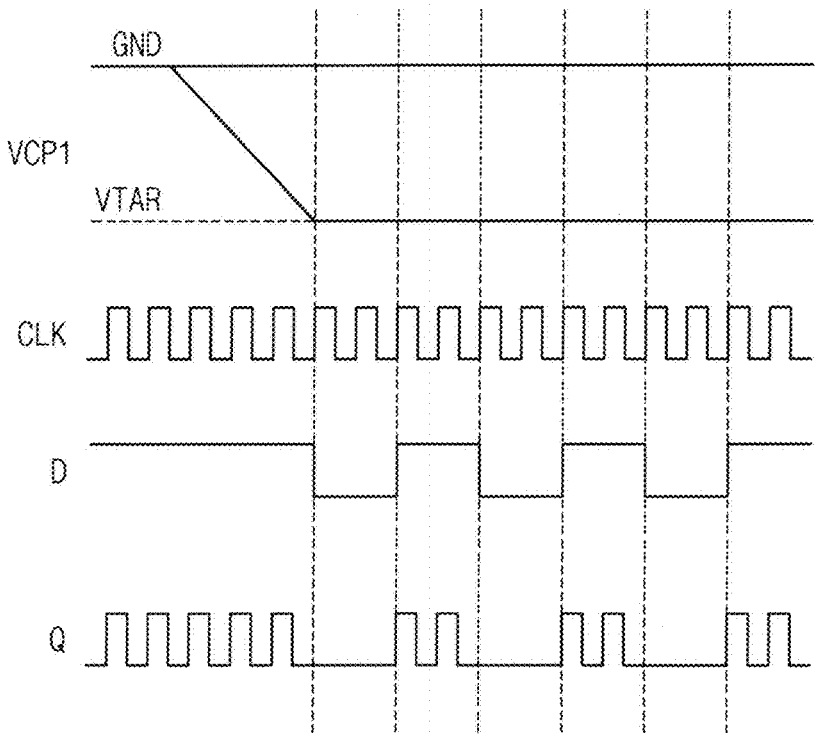
FIG. 7 is a timing diagram illustrating an embodiment of an input signal and an output signal of a flip-flop of FIG. 5 and the output signal of the first charge pump of FIG. 5.
FIG. 8 is a table illustrating a register for setting an operator of FIG. 5.

FIG. 5 is a circuit diagram illustrating an embodiment of the first charge pump 710 of FIG. 4. FIG. 6 is a timing diagram illustrating an embodiment of an input signal, a node signal and an output signal of the first charge pump 710 of FIG. 5. FIG. 7 is a timing diagram illustrating an embodiment of an input signal and an output signal of a flip-flop FF of FIG. 5 and the output signal of the first charge pump 710 of FIG. 5.

Referring to FIGS. 1 to 7, an embodiment of the first charge pump 710 may include an operator 711, a comparator A5, a flip-flop FF and a switching controller 712. The operator 711 may generate a reference charge pumping voltage varied according to the target voltage. The comparator A5 may compare a feedback voltage of the charge pumping voltage VCP1 and the reference charge pumping voltage. The flip-flop FF may output a control signal based on a clock signal CLK and an output signal of the comparator A5. The flip-flop FF may further receive the clock signal CLK as a reset signal RST. The switching controller 712 may generate a switching control signal SWS based on an output signal of the flip-flop FF.

The feedback voltage of the charge pumping voltage VCP1 may be inputted to the comparator A5 through a feedback resistor string FRS connected to an output node of the charge pumping voltage VCP1.

In an embodiment, when the absolute value of the feedback voltage is less than the reference charge pumping voltage, the output signal (D in FIG. 7) of the comparator A5 may have a first level. In such an embodiment, when the absolute value of the feedback voltage is equal to or greater than the reference charge pumping voltage, the output signal (D in FIG. 7) of the comparator A5 may have a second level. Herein, the first level may be a high level and the second level may be a low level.

The first charge pump 710 may further include a first amplifier A1, a second amplifier A2, a third amplifier A3 and a fourth amplifier A4 which receive the switching control signal SWS, a first switch S1 connected to the first amplifier A1, a second switch S2 connected to the second amplifier A2, a third switch S3 connected to the third amplifier A3 and a fourth switch S4 connected to the fourth amplifier A4.

Output signals of the first amplifier A1 and the second amplifier A2 may be inverted.

The first switch S1, the fourth switch S4, the second switch S2 and the third switch S3 may be sequentially connected to each other in series. In an embodiment, the first switch S1 is connected to a ground PGND.

The first charge pump 710 may include a first capacitor C1 and a second capacitor C2. The first capacitor C1 may include a first electrode connected to the first switch S1 and the fourth switch S4 (or a switch node SWN) and a second electrode connected to the second switch S2 and the third switch S3 (or a capacitor node CPN). The second capacitor C2 may include a first electrode connected to the third switch S3 and a second electrode connected to a ground (GND in FIG. 7). The first capacitor C1 may be a charging capacitor. The second capacitor C2 may be a stabilization capacitor of the charge pumping voltage VCP1.

When the switching control signal SWS has a first level SWSH, the first switch S1 and the second switch S2 may be turned on and the third switch S3 and the fourth switch S4 may be turned off. When the switching control signal SWS has a second level SWSL, the third switch S3 and the fourth switch S4 may be turned on and the first switch S1 and the second switch S2 may be turned off. Herein, the first level may be a high level and the second level may be a low level.

When the switching control signal SWS has the first level SWSH, the first capacitor C1 may be charged. When the switching control signal SWS has the second level SWSL, the voltage charged at the first capacitor C1 may be outputted to the first regulator 520 through the third switch SW3. The current flow when the switching control signal SWS has the first level SWSH and the current flow when the switching control signal SWS has the second level SWSL are respectively represented by dotted lines in FIG. 5.

In an embodiment, as shown in FIG. 6, when the switching control signal SWS has the first level SWSH (PE2), the first capacitor C1 is charged, a current of the first capacitor C1 (IC1) is represented to negative and the second switch S2 is turned on (See IS2). When the switching control signal SWS has the second level SWSL (PE1 and PE3), the first capacitor C1 is discharged, the current of the first capacitor C1 (IC1) is represented to positive, and the first switch S1 and the third switch S3 are turned on (See IS3).

The switching control signal SWS alternately has the first level SWSH and the second level SWSL so that the first charge pumping voltage VCP1 may maintain the target level.

In FIG. 7, when the absolute value of the first charge pumping voltage VCP1 is less than the target voltage VTAR, the output signal D of the first comparator A5 has the high level. When the output signal D of the first comparator A5 has the high level, the flip-flop FF may output the clock signal CLK as an output signal Q.

When the absolute value of the first charge pumping voltage VCP1 is equal to or greater than the target voltage VTAR, the output signal D of the first comparator A5 has the low level. When the output signal D of the first comparator A5 has the low level, the flip-flop FF may output a low level as the output signal Q.

The switching controller 712 generates the switching control signal SWS based on the output signal of the flip-flop FF.

The first charge pump 710 may further include a level shifter 713 connected between the switching controller 712 and the first to fourth amplifiers A1 to A4. The level shifter 713 may increase the level of the switching control signal SWS and output the switching control signal SWS having the increased level to the first to fourth amplifiers A1 to A4.

FIG. 8 is a table illustrating an embodiment of the register for setting the operator 711 of FIG. 5. FIG. 8 represents one embodiment of the register for setting the operator 711. In an embodiment, the operator 711 of the first charge pump 710 may generate the reference charge pumping voltage using the register that stores the headroom margin HM-VCP1 of the first charge pumping voltage and the headroom margins based on the output load ILOAD1 to ILOADN. In such an embodiment, an operator of the second charge pump 730 may generate the reference charge pumping voltage using the register that stores the headroom margin HM-VCP2 of the second charge pumping voltage and the headroom margins based on the output load ILOAD1 to ILOADN. In such an embodiment, an enable setting HM-VCP1-EN of a headroom margin adjusting function of the first charge pump and an enable setting HM-VCP2-EN of a headroom margin adjusting function of the second charge pump may be stored in the register.

Figures 9, 10:
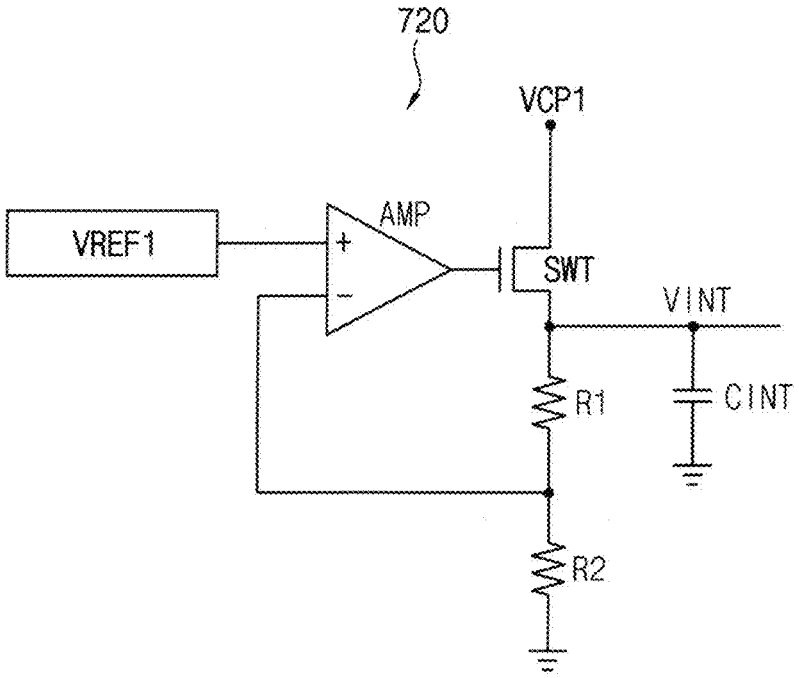
FIG. 9 is a circuit diagram illustrating an embodiment of a first regulator of FIG. 4.
FIG. 10 is a table illustrating a power consumption of a comparative embodiment and a power consumption of an embodiment of the invention.

FIG. 9 is a circuit diagram illustrating an embodiment of the first regulator 720 of FIG. 4.

Referring to FIGS. 1 to 9, an embodiment of the first regulator 720 may include a fifth amplifier AMP and a fifth switch SWT connected to an output node of the fifth amplifier AMP. A control node of the fifth switch SWT may be connected to the output node of the fifth amplifier AMP. The charge pumping voltage may be applied to an input electrode of the fifth switch SWT. An output node of the fifth switch SWT may output the power voltage VINT.

The first regulator 720 may further include a first register R1, a second register R2 and a stabilization capacitor CINT. The first register R1 may include a first end portion connected to the output node of the fifth switch SWT and a second end portion connected to a first input node of the fifth amplifier AMP. The second register R2 may include a first end portion connected to the second end portion of the first register R1 and a second end portion connected to the ground. The stabilization capacitor CINT may include a first electrode connected to the output node of the fifth switch SWT and a second electrode connected to a ground.

A target voltage VREF1 of the power voltage VINT may be inputted to a second input node of the fifth amplifier AMP.

FIG. 10 is a table illustrating a power consumption of a comparative embodiment and a power consumption of an embodiment of the invention.

Referring to FIGS. 1 to 10, a power voltage generator of the comparative embodiment does not adjust the headroom margin based on the target voltage so that the power consumption may be relatively high (10.5 milliwatts (mW), 20.5 mW and 31 mW). In the comparative embodiment, the charge pumping voltage VCP1 for generating the initialization voltage VINT of −3.5 V may be fixed to −7.8 V (−PAVDD) so that the headroom margin of the first charge pumping voltage VCP1 for generating the initialization voltage VINT may be 4.3 V. The power consumption may be calculated as a multiplication of the headroom margin and a load current. In the comparative embodiment, the charge pumping voltage VCP2 for generating the gate low voltage VGL of −8.8 V may be fixed to −11.1 V (−PAVDD-VIN) so that the headroom margin of the second charge pumping voltage VCP2 for generating the gate low voltage VGL may be 2.3 V.

In an embodiment of the invention, the power voltage generator 700 adjusts the headroom margin based on the target voltage so that the power consumption may be relatively low (1.5 mW, 1.5 mW and 3 mW). In such an embodiment, the charge pumping voltage VCP1 for generating the initialization voltage VINT of −3.5 V may be adjusted to −3.8 V by subtracting the headroom margin of 0.3 V from the initialization voltage VINT of −3.5 V. The headroom margin of the charge pumping voltage VCP1 for generating the initialization voltage VINT may be 0.3 V. Thus, in an embodiment of the invention, the power consumption to generate the initialization voltage VINT may be substantially less than the power consumption of the comparative embodiment. In such an embodiment, the charge pumping voltage VCP2 for generating the gate low voltage VGL of −8.8 V may be adjusted to −9.1 V by subtracting the headroom margin of 0.3 V from the gate low voltage VGL of −8.8 V. The headroom margin of the charge pumping voltage VCP2 for generating the gate low voltage VGL may be 0.3 V. Thus, in such an embodiment, the power consumption to generate the gate low voltage VGL may be substantially less than the power consumption of the comparative embodiment. As shown in FIG. 10, a difference between the power consumption to generate the initialization voltage VINT in the comparative embodiment and the power consumption to generate the initialization voltage VINT in the embodiment of the invention may be about 9 mW and a difference between the power consumption to generate the gate low voltage VGL in the comparative embodiment and the power consumption to generate the gate low voltage VGL in the embodiment of the invention may be about 19 mW. Thus, the difference of the total power consumption of the comparative embodiment and the total power consumption of the embodiment may be about 28 mW.

Figure 11:
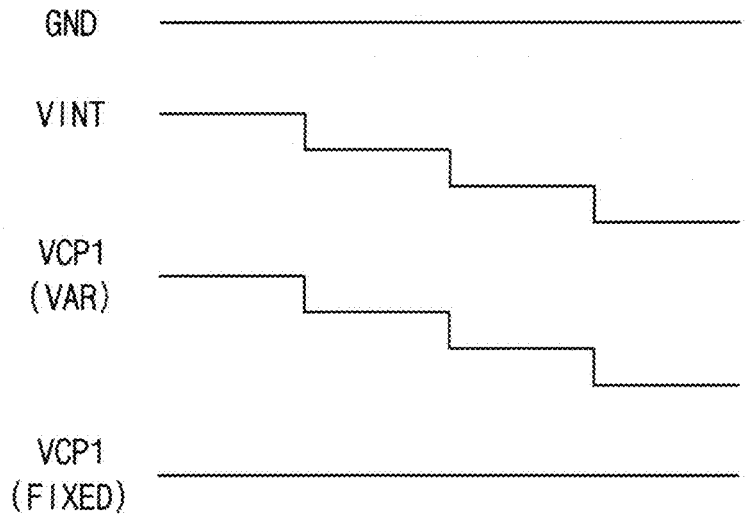
FIG. 11 is a timing diagram illustrating a first charge pumping voltage of the comparative embodiment and a first charge pumping voltage of an embodiment based on a target voltage.
Figure 12:
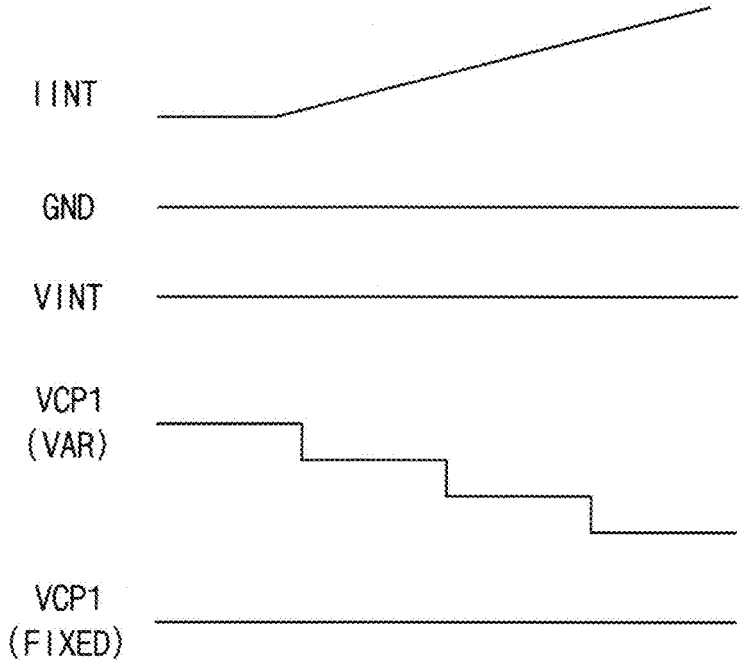
FIG. 12 is a timing diagram illustrating the first charge pumping voltage of the comparative embodiment and the first charge pumping voltage of an embodiment based on an output load.

FIG. 11 is a timing diagram illustrating a first charge pumping voltage of the comparative embodiment and a first charge pumping voltage of an embodiment based on a target voltage. FIG. 12 is a timing diagram illustrating the first charge pumping voltage of the comparative embodiment and the first charge pumping voltage of an embodiment according to an output load.

As shown in FIG. 11, even if the target voltage VINT decreases, a fixed charge pumping voltage VCP1(FIXED) is generated in the comparative embodiment. In an embodiment of the invention, as the target voltage VINT decreases, a decreasing charge pumping voltage VCP1(VAR) is generated. In one embodiment, for example, as the absolute value of the target voltage VINT increases, the absolute value of the charge pumping voltage VCP1(VAR) may increase.

As shown in FIG. 12, even if a current IINT increases according to the output load, a fixed charge pumping voltage VCP1(FIXED) is generated in the comparative embodiment. In an embodiment of the invention, when the target voltage VINT is fixed, a decreasing charge pumping voltage VCP1 (VAR) is generated as the output load increases. In one embodiment, for example, as the output load increases, the absolute value of the charge pumping voltage VCP1(VAR) may increase.

According to embodiments of the invention, the charge pump may generate the charge pumping voltage having the automatically set headroom margin and varied based on the target voltage so that the headroom margin of the charge pumping voltage may be optimized. Thus, the power consumption of the display apparatus may be reduced.

In such embodiments, the charge pump circuit may adjust the headroom margin of the charge pumping voltage based on the intensity of the output load so that the headroom margin of the charge pumping voltage may be further optimized. Thus, the power consumption of the display apparatus may be further reduced.

According to embodiments of the invention as described above, the power consumption of the display apparatus may be reduced.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A power voltage generator comprising:

a charge pump which generates a charge pumping voltage; and a regulator which generates a power voltage based on the charge pumping voltage, wherein the charge pumping voltage is set to be a voltage obtained by subtracting a headroom margin from a target voltage of the power voltage generated from the regulator, wherein the headroom margin is automatically set based on an output load of the power voltage generated from the regulator, wherein an absolute value of the charge pumping voltage increases as an absolute value of the target voltage increases, and wherein when the target voltage is fixed, an absolute value of the charge pumping voltage increases as the output load increase.

2. The power voltage generator of claim 1, wherein the charge pump comprises:

an operator which generates a reference charge pumping voltage which is varied based on the target voltage;

a comparator which compares a feedback voltage of the charge pumping voltage and the reference charge pumping voltage;

a flip-flop which outputs a control signal based on a clock signal and an output signal of the comparator; and a switching controller which generates a switching control signal based on an output signal of the flip-flop.

3. The power voltage generator of claim 2, wherein the charge pump further comprises:

a first amplifier, a second amplifier, a third amplifier and a fourth amplifier which receive the switching control signal;

a first switch connected to the first amplifier;

a second switch connected to the second amplifier;

a third switch connected to the third amplifier; and a fourth switch connected to the third amplifier, wherein the first switch, the fourth switch, the second switch and the third switch are sequentially connected to each other in series.

4. The power voltage generator of claim 3, wherein the charge pump further comprises:

a first capacitor comprising a first electrode connected to the first switch and the fourth switch, and a second electrode connected to the second switch and the third switch; and a second capacitor comprising a first electrode connected to the third switch, and a second electrode connected to a ground.

5. The power voltage generator of claim 4, wherein when the switching control signal has a first level, the first switch and the second switch are turned on and the third switch and the fourth switch are turned off, and wherein when the switching control signal has a second level, the third switch and the fourth switch are turned on and the first switch and the second switch are turned off.

6. The power voltage generator of claim 5, wherein when the switching control signal has the first level, the first capacitor is charged, and wherein when the switching control signal has the second level, a voltage charged at the first capacitor is outputted to the regulator through the third switch.

7. The power voltage generator of claim 3, further comprising:

a level shifter connected between the switching controller and the first to fourth amplifiers.

8. The power voltage generator of claim 3, wherein when an absolute value of the feedback voltage is less than the reference charge pumping voltage, the output signal of the comparator has a first level, and wherein when the absolute value of the feedback voltage is equal to or greater than the reference charge pumping voltage, the output signal of the comparator has a second level.

9. The power voltage generator of claim 1, wherein the regulator comprises:

a fifth amplifier; and a fifth switch connected to an output node of the fifth amplifier, wherein a control node of the fifth switch is connected to the output node of the fifth amplifier, wherein the charge pumping voltage is applied to an input node of the fifth switch, and wherein an output node of the fifth switch outputs the power voltage.

10. The power voltage generator of claim 9, wherein the regulator further comprises:

a first resistor including a first end portion connected to the output node of the fifth switch, and a second end portion connected to a first input node of the fifth amplifier;

a second resistor including a first end portion connected to the second end portion of the first resistor, and a second end portion connected to a ground; and a stabilization capacitor including a first electrode connected to the output node of the fifth switch, and a second electrode connected to the ground.

11. A display apparatus comprising:

a display region which displays an image;

a gate driver which provides a gate signal to the display region;

a data driver which provides a data voltage to the display region; and a power voltage generator which outputs a power voltage to at least one selected from the display region, the gate driver and the data driver, wherein the power voltage generator comprises:

a charge pump which generates a charge pumping voltage; and a regulator which generates the power voltage based on the charge pumping voltage, wherein the charge pumping voltage is set to be a voltage obtained by subtracting a headroom margin from a target voltage of the power voltage generated from the regulator, wherein the headroom margin is automatically set based on an output load of the power voltage generated from the regulator, wherein an absolute value of the charge pumping voltage increases as an absolute value of the target voltage increases, and wherein when the target voltage is fixed, an absolute value of the charge pumping voltage increases as the output load increases.

12. The display apparatus of claim 11, wherein the power voltage is an initialization voltage outputted to a pixel of the display region.

13. The display apparatus of claim 11, wherein the power voltage is a gate low voltage outputted to the gate driver, and wherein the gate low voltage defines a low level of the gate signal.

14. The display apparatus of claim 11, wherein the power voltage generator further comprises:

a second charge pump which generates a second charge pumping voltage, wherein the second charge pumping voltage has an automatically set second headroom margin, and the second charge pumping voltage is varied based on a second target voltage; and a second regulator which generates a second power voltage based on the second charge pumping voltage.

15. The display apparatus of claim 14, wherein the power voltage is an initialization voltage outputted to a pixel of the display region, wherein the second power voltage is a gate low voltage outputted to the gate driver, and wherein the gate low voltage defines a low level of the gate signal.

16. A method of generating a power voltage, the method comprising:

generating a charge pumping voltage; and generating the power voltage based on the charge pumping voltage, wherein the charge pumping voltage is set to be a voltage obtained by subtracting a headroom margin from a target voltage of the power voltage generated from the regulator, wherein the headroom margin is automatically set based on an output load of the power voltage generated from the regulator, wherein an absolute value of the charge pumping voltage increases as an absolute value of the target voltage increases, and wherein when the target voltage is fixed, an absolute value of the charge pumping voltage increases as the output load increases.

* * * * *